United States Patent [19]

DeSantis

[11] 4,418,501

[45] Dec. 6, 1983

[54] LAPPING MACHINE AND METHOD

[75] Inventor: Raymond P. DeSantis, Troy, Mich.

[73] Assignee: PTX-Pentronix, Inc., Lincoln Park, Mich.

[21] Appl. No.: 264,037

[22] Filed: May 15, 1981

[51] Int. Cl.[3] ..... B24B 25/00

[52] U.S. Cl. ..... 51/157

[58] Field of Search ..... 51/157, 160, 158, 60

[56] References Cited

U.S. PATENT DOCUMENTS

| | | | |
|---|---|---|---|
| 180,707 | 8/1876 | Eusminger | 51/60 |
| 1,491,101 | 4/1924 | Hoke | 51/157 |
| 1,537,658 | 5/1925 | Carhart | 51/60 |
| 1,612,470 | 12/1926 | Russ | 51/60 |
| 4,060,939 | 12/1977 | Dubied | 51/157 |

*Primary Examiner*—Harold D. Whitehead

*Attorney, Agent, or Firm*—Hauke and Patalidis

[57] ABSTRACT

A lapping method and apparatus providing accurate lapping of a workpiece surface and substantially even wear of the lap surface in the course of a lapping operation cycle. The workpiece having a surface to be lapped is held in an oscillating plate reciprocated along a first axis, and displaced at a much lower rate along a second axis. The plate is reciprocated along the first axis by means of a rigid link pivotally attached at one end to the plate and at another end to a rotating eccentric. The plate is displaced along the second axis by means of a pair of rigid parallel links pivotally attached to the plate at one end and pivotally attached each to a rotating eccentric at their other end.

4 Claims, 5 Drawing Figures

LAPPING MACHINE AND METHOD

BACKGROUND OF THE INVENTION

The present invention relates to lapping machines and methods in general and more particularly to a machine and method for lapping a hard metallic surface on a lap plate charged with an abrasive compound.

A multiplicity of tools used on machine tools for cutting, piercing, etc. have flat surfaces which must be ground and subsequently finish lapped to a high degree of surface finish and flatness. Example of such tools are punches, die plates, gages, etc. The surfaces to be lapped are generally very hard as being composed of hardened tool steels, carbides and the like. Lapping is effected on a lap in the form of a plate, for example, of cast iron, having a precisely flat surface loaded with an abrasive compound such as diamond, silicon carbide, fused alumina or boron carbide powder for example. A "vehicle" or binder, in the form of an oil or grease base lubricant is used for wetting and lubricating the surface being lapped, the surface of the lap plate and the abrasive particles. Lapping of a workpiece surface is effected by rubbing the surface to be lapped in engagement with the abrasive-loaded lap plate, back and forth in a regular motion, in an orbiting motion, in a figure eight motion, or in a circular motion.

Lapping may be effected manually, which requires considerable skill and experience on the part of the worker, or it may be effected by means of power operated apparatus or machines. Whatever the method used for lapping a workpiece surface, it is a delicate and slow operation. Care must be taken to utilize evenly all of the surface of the lap plate, and to avoid lapping constantly over the same areas of the lap plate, thus causing uneven wear of the surface which in turn defeats entirely the results sought to be accomplished by lapping a surface to a high finish and an accurate flatness.

SUMMARY OF THE INVENTION

The present invention has for principal objects to provide an automatic power operated lapping machine which can be accurately set to effectuate a lapping operation utilizing the whole surface of a lap plate, such as to produce even wear on the lap plate and preserving the original flatness and accuracy of the plate surface. Furthermore, the present invention provides a power operated lapping machine having a multiplicity of lapping stations operated in unison, the lapping stations being in the form of openings in a plate oscillated back and forth along an axis above lap plates each disposed such as to correspond to one of the openings, the oscillating plate being further displaced along an axis generally perpendicular to the axis of oscillation such that a workpiece held in one of the lapping stations is caused to travel, with its surface to be lapped in engagement with the lap plate, over the whole surface area of the lap plate. The invention thus provides an automatic lapping machine that presents the advantages of accurate lapping of a surface to be lapped and even wear of the lap plate surface, which requires very little background experience and skill on the part of its operator, and which is capable of simultaneously lapping a plurality of workpieces.

These and other objects and advantages of the present invention will become apparent to those skilled in the art when the following description of an example of apparatus well suited for accomplishing such objects and for practicing the method of the invention is read in conjunction with the accompanying drawings wherein like reference numerals refer to like parts and in which:

DETAILED DESCRIPTION OF THE PREFERRED EMBODIMENT

Figure 1:
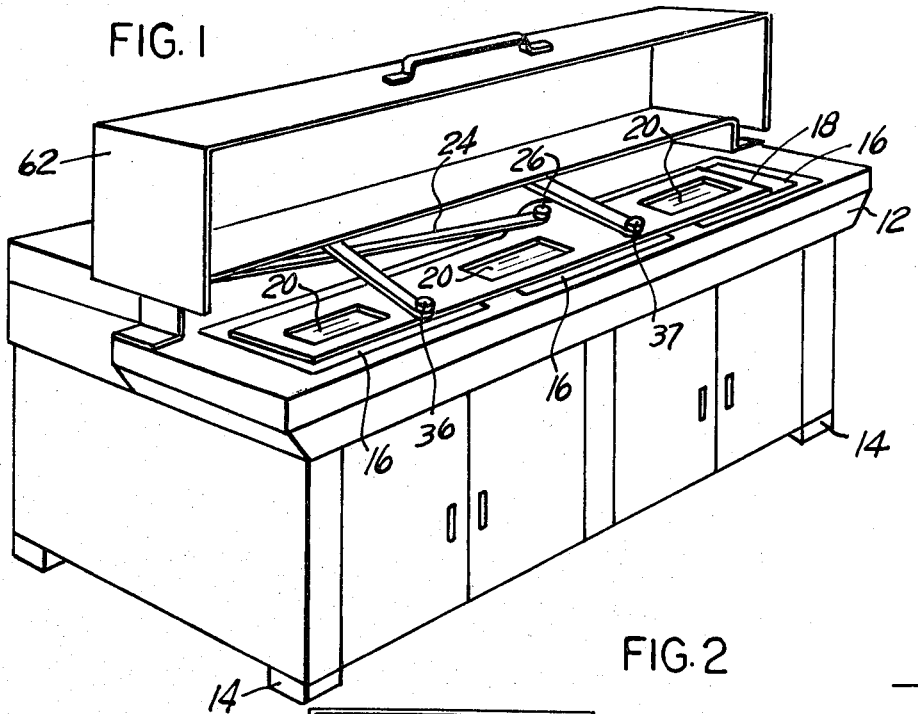
FIG. 1 is a front perspective schematic view of an example of lapping machine according to the present invention.
Figure 2:
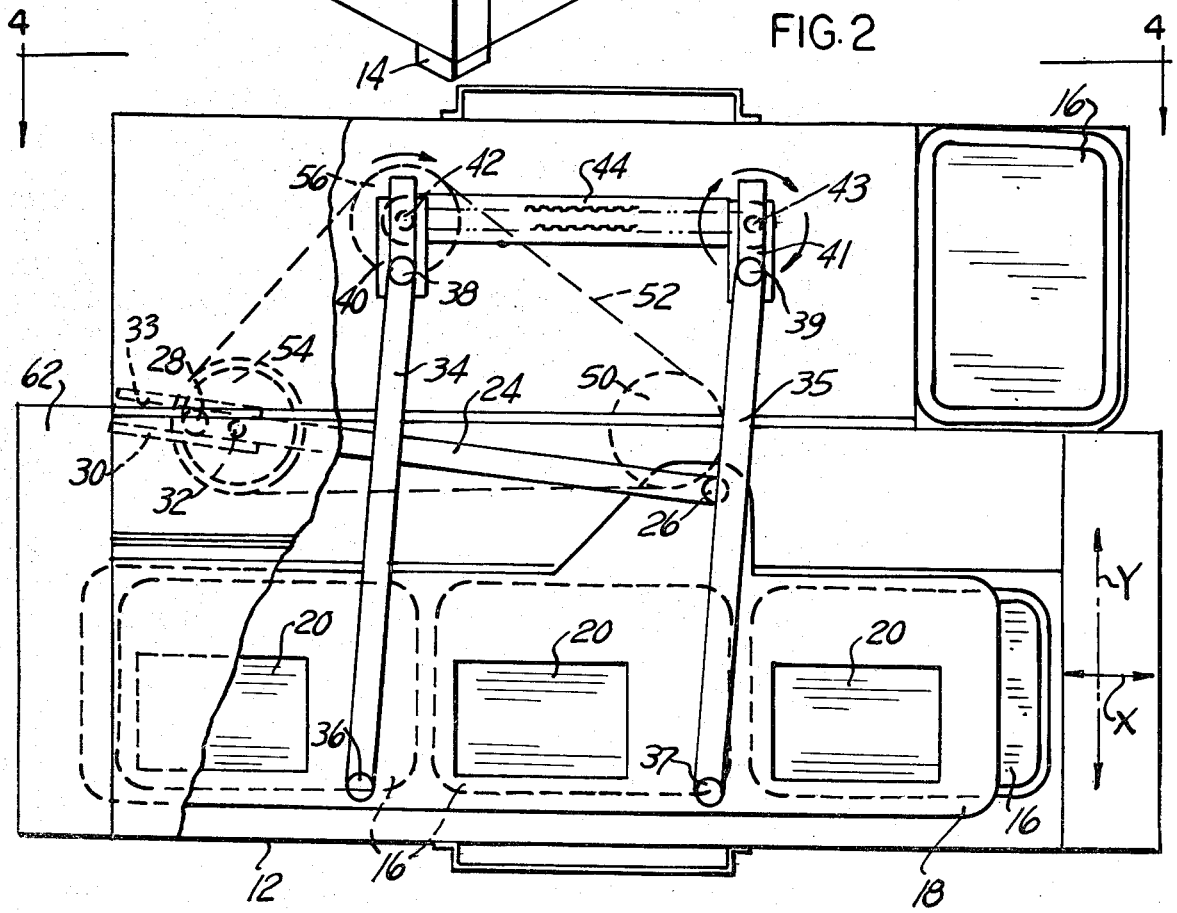
FIG. 2 is a top elevation schematic view thereof with some portions removed to show the internal structure.
Figure 3:
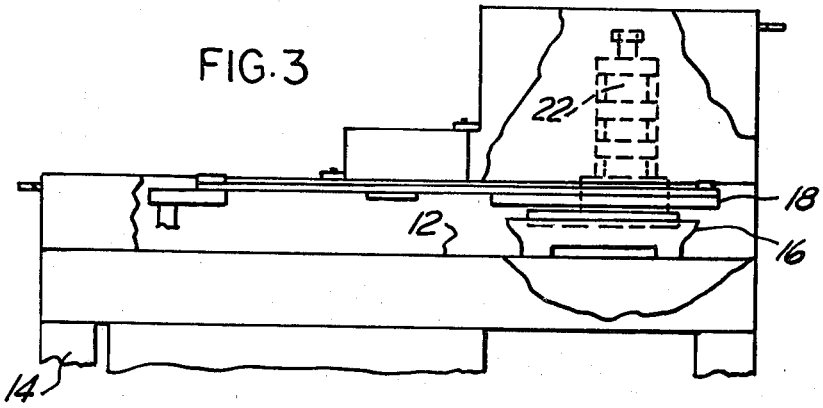
FIG. 3 is a side elevation schematic view thereof with some portions removed to show the internal structure.

Referring now to the drawings and more particularly to FIGS. 1–3, a lapping machine according to the present invention comprises a table 12 supported by two pair of legs 14. The table 12 has, in the example of structure illustrated, three recesses in each of which is disposed a lap in the form of a plate 16. An oscillating plate 18 is disposed over the lap plates 16, the oscillating plate being provided with a workpiece mounting opening 20 corresponding to each lap plate 16. One or more lap plates 16 may be stored on the rear of the table 12, as shown at FIG. 2.

In operation, a workpiece as shown at 22 at FIG. 3, having a face to be lapped is mounted in one of the plate openings 20 such that the workpiece face has its surface in engagement with a corresponding lap plate 16, whose surfaces is loaded with an abrasive compound. The oscillating plate 18 is oscillated along the X-axis for example, by way of a link in the form of a bar 24 having an end pivotally attached, as shown at 26, to a side of the plate 18, the other end of the link 24 being pivotally attached to an eccentric pin 28 mounted on an arm 30, FIG. 2, attached to the upper end of a vertically disposed shaft 32. The eccentric pin 28 is mounted on a slide 33 forming part of the arm 30, with the result that the radial position of the eccentric pin 28 along the arm 30 is adjustable such that the stroke of the oscillating plate 18 along the X-axis, during one full revolution of the shaft 32, may be adjustably pre-established. The oscillating plate 18 is held against uncontrolled displacement on the Y-axis, perpendicular to the X-axis, by means of two parallel links in the form of bars 34 and 35 attached at an end to the side of the plate 18 by pivot means 36 and 37, respectively. The link bars 34 and 35 are pivotally attached at their other end respectively to an eccentric pin 38 and an eccentric pin 39 adjustably mounted on an arm 40 and an arm 41, respectively. The arms 40 and 41 are fastened, respectively, to vertically disposed shafts 42 and 43. The shafts 42 and 43 are constrained to rotate in unison at equal angular velocity and with the arms 40 and 41 constantly remaining parallel to one another by a timing cog belt 44 wound around a pair of timing cog wheels each mounted on one of the shafts 42 and 43.

Figure 4:
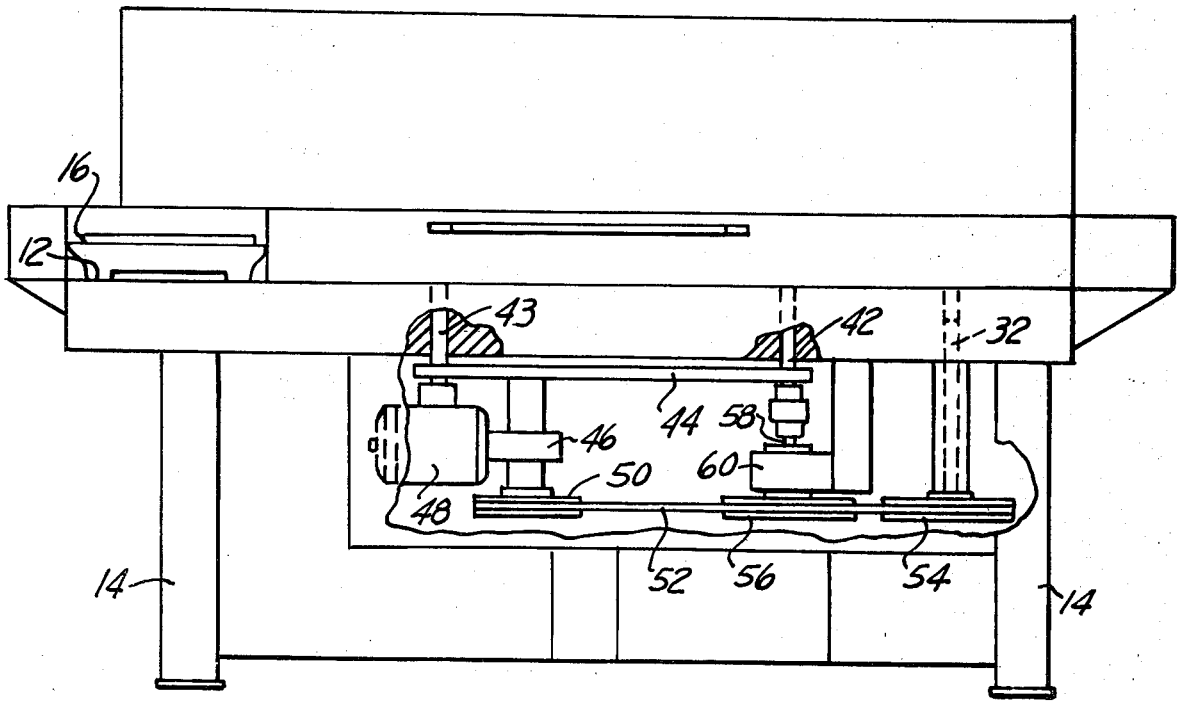
FIG. 4 is a rear elevation schematic view thereof with portions removed to show the machine drive mechanism.
Figure 5:
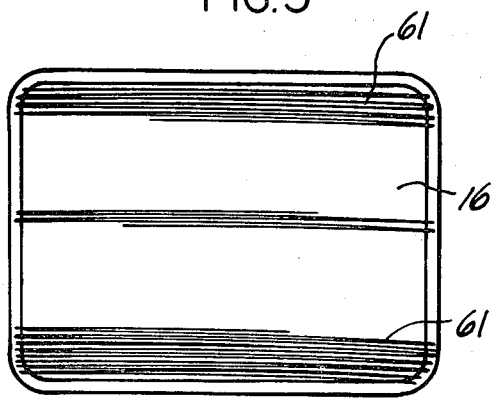
FIG. 5 is a diagram of the motion, over the surface of a lap plate, of a point of a workpiece surface while being lapped by the lapping machine for practicing the method of the present invention.

As best shown in FIG. 4, the shaft 32 is belt-driven, through a gear drive 46 mounted below the table 12, by an electric motor 48, the output of the gear drive 46 being provided with a pulley 50 which drives by means of a V-belt 52 a pulley 54 mounted at the bottom end of the shaft 32. The belt 52 also drives through a pulley 56 the output shaft 58 of a gear reducer 60. The gear reducer 60 is coupled to the shaft 42 which, as previously mentioned, is in turn coupled to the shaft 43 by means of the timing belt 44. The gear reducer 60 has, for example, a 100 to 1 ratio, such that assuming the drive pulley 56 of the gear reducer 60 and the drive pulley 54 for the shaft 32 being of equal diameters, the shafts 42 and 43 rotates a single revolution for each 100 revolutions of the shaft 32. As each complete revolution of the shaft 32 causes a complete back and forth reciprocation of the oscillating plate 18 along the X-axis, the plate forming a side of the deformable parallelogram defined by the parallel link bars 34 and 35 attached by the pivots 36 and 37 to the oscillating plate 18 on one end and by the eccentric pins 38 and 39 on the arms 40 and 41, respectively, on the end of the shafts 42 and 43, the oscillating plate 18 is simultaneously displaced along the Y-axis of an increment corresponding to 1/100th of a revolution of the shafts 42 and 43. The result is that every point of the lapped surface of a workpiece 22 mounted in a mounting opening 20 of the oscillating plate 18 describes, in the course of a half revolution of the shafts 42 and 43 a zig-zag path, as shown at 61 at FIG. 5, which covers the whole area of the surface of the corresponding lap plate 16. Even wear of the surface of the lap plate and preservation of its original flatness are thus achieved.

It will be readily appreciated by those skilled in the art that the oscillating plate 18 may have any number of mounting openings 20, a lap plate 16 being disposed on the table 12 for each workpiece mounting opening or station. The workpieces are held in the mounting openings 20 by any convenient conventional means, not shown, such as clamps, bolts, vises or chucks.

The machine of the invention is provided with a hinged cover 62 which, during lapping of a workpiece, is placed in position over the oscillating plate 18. Appropriate spray nozzles, not shown, are disposed under the hinged cover 62 such as to spray the surface of the lap plates 16 with an appropriate lubricant. The oscillating plate 18 is simply urged by gravity and by weight of the workpieces mounted in the mounting openings 20 toward the surface of the lap plates 16. Support bearing surfaces in the form of strips of plastic, for example, may be disposed between the recesses containing the lap plates 16, and shims or other spacing members may be used during original set-up for supporting the plate 18 further away from the bearing surfaces or ways and for providing original set-up for the thickness of metal to be removed from the face of the workpiece being lapped. The original position of the Y-axis eccentric pins 38 and 39 and the position of the X-axis eccentric pin 28 are originally set up such that the whole width of the lap plates 16 is rubbed by the workpiece face from one side edge to the other during each half revolution of the shaft 32, and from one longitudinal edge to the other during each half revolution of the shafts 42 and 43.

Having thus described the present invention by way of an example of structure well adapted to achieve the objects of the invention and to practice the method of the invention, modification whereof will be apparent to those skilled in the art, what is claimed as novel is as follows:

I claim:

1. A lapping machine comprising at least one lap plate, a workpiece holding plate disposed proximate said lap plate and adapted to hold a workpiece with a surface thereof in engagement with said lap plate, power means for reciprocating said holding plate along a first axis of direction, power means for displacing said holding plate along a second axis of direction, said second axis being at an angle to said first axis, such that to each complete reciprocation cycle along said first axis corresponds a small displacement along said second axis, and means for adjusting the length of displacement of said holding plate along said first axis and said second axis for causing a point of the surface in engagement with said lap plate to travel substantially over the whole area of said lap plate in the course of a lapping operation cycle, wherein said means for displacing said holding plate along said first axis comprises a first link pivotally attached at one end to said holding plate and pivotally attached at another end to a first eccentric, and a first power driven rotatable shaft for rotating said first eccentric, and wherein said means for displacing said holding plate along said second axis comprises a second rigid link and a third rigid link disposed substantially parallel, each of said second and third links being pivotally attached at one end to said holding plate and pivotally attached at another end respectively to a second and third eccentrics, and a second and third power driven rotatable shafts each rotating respectively said second eccentric and said third eccentric.

2. The lapping machine of claim 1 wherein said means for adjusting the length of displacement of said holding plate along said second axis comprises an arm mounted on each of said shafts, and an adjustable slide on each said arm supporting said eccentric at a predetermined radius about the axis of said shaft.

3. The lapping machine of claim 1 wherein said second and third shafts are coupled such that each revolution of said second shaft corresponds to a revolution of said third shaft.

4. The lapping machine of claim 3 wherein said second and third shafts rotate one revolution for about 100 revolutions of rotation of said first shaft.

* * * * *